US006639567B2

(12) United States Patent
Chang et al.

(10) Patent No.: US 6,639,567 B2
(45) Date of Patent: Oct. 28, 2003

(54) LOW RADAR CROSS SECTION RADOME

(75) Inventors: Yueh-Chi Chang, Northborough, MA (US); Court E. Rossman, Prunedale, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/952,835

(22) Filed: Sep. 14, 2001

(65) Prior Publication Data

US 2003/0052833 A1 Mar. 20, 2003

(51) Int. Cl.[7] ..... H01Q 1/42
(52) U.S. Cl. ..... 343/872
(58) Field of Search ..... 343/872, 753, 343/910, 911 R; H01Q 1/42

(56) References Cited

U.S. PATENT DOCUMENTS 4,872,019 A * 10/1989 Chow et al. ..... 343/753
5,757,327 A * 5/1998 Yajima et al. ..... 343/713
5,828,339 A * 10/1998 Patel ..... 343/700 MS
6,191,753 B1 * 2/2001 Ellis et al. ..... 343/872

* cited by examiner

*Primary Examiner*—Hoanganh Le
(74) *Attorney, Agent, or Firm*—Iandiorio & Teska

(57) ABSTRACT

A low radar cross section radome including a lower inwardly diverging cone portion; an intermediate outwardly diverging cone portion on the lower inwardly diverging cone portion; and a curved top portion on the intermediate outwardly diverging cone portion.

8 Claims, 7 Drawing Sheets

LOW RADAR CROSS SECTION RADOME

FIELD OF THE INVENTION

This invention relates to radomes.

BACKGROUND OF THE INVENTION

Radomes are the housings which shelter an antenna assembly on the ground, on a ship, or on an airplane and the like against the elements. Radomes can be made of many different materials and are generally spherical in shape, shaped like a light bulb, or cylindrical in shape.

Radomes of these shapes, however, fail to meet the radar cross section (RCS) requirements imposed by government agencies. That is, although prior art radomes may adequately shelter the antenna assembly, because of their geometric shape, they have a high RCS and thus can be detected by enemy radar easily. Unfortunately, radar absorbing materials can not generally be used in conjunction with radomes because these materials would cause the blockage of the antenna assembly inside the radome.

The U.S. Government itself proposed a radome with an outwardly diverging wall. But, although this radome geometry seemed to have a lower RCS, its footprint was unacceptably large due to the outwardly diverging wall and thus could not be used in many applications (e.g., on board a ship) where space is a premium. In addition, this radome geometry does not lend itself to retrofit of existing antenna assembly installations.

Accordingly, there is a need for a radome with a low RCS designed such that it does not degrade the radar transmitting performance of the antenna assembly housed by the radome and which also has a footprint similar to existing radomes.

SUMMARY OF THE INVENTION

It is therefore an object of this invention to provide a low radar cross section (RCS) radome.

It is a further object of this invention to provide radome which is proven through testing to meet the United States Government's RCS requirements.

It is a further object of this invention to provide a low RCS radome which does not cause blockage of the antenna assembly inside the radome.

It is a further object of this invention to provide a low RCS radome which does not degrade the transmitting performance of the antenna assembly.

It is a further object of this invention to provide a low RCS radome which has an acceptable footprint.

It is a further object of this invention to provide a low RCS radome which can be retrofitted for use in conjunction with existing antenna assembly installations.

The invention results from the realization that a low radar cross section radome proven in testing to meet the United States Government's requirements and which does not block signals from reaching the antenna assembly inside the radome, which has an acceptable footprint, and which can be retrofitted for use in conjunction with existing antenna assembly installations is effected by designing the radome to have a curved top portion, an outwardly diverging wall extending from the curved top portion, and an inwardly diverging wall extending from the outwardly diverging wall down to the base portion of the radome.

This invention features a low radar cross section radome comprising a lower inwardly diverging cone portion; an intermediate outwardly diverging cone portion on the lower inwardly diverging cone portion; and a curved top portion on the intermediate outwardly diverging cone portion.

In the preferred embodiment, the divergence angle of the lower cone portion is between 12° and 15° and the divergence angle of the intermediate cone portion is between 25° and 35°. Typically, the divergence angle of the intermediate cone portion is 10° greater than the divergence angle of the lower cone portion. Also in the preferred embodiment, the outer surface of the radome is smooth and continuous and the curved top portion is spherical in shape.

The low radar cross section radome of this invention has a lower inwardly diverging wall; an intermediate outwardly diverging wall extending upwards from the lower inwardly diverging wall; and a curved top portion on the intermediate outwardly diverging wall. In the preferred embodiment, the divergence angle of the lower inwardly diverging wall is between 12° and 15° and the divergence angle of the intermediate outwardly diverging wall is 10° greater than the divergence angle of the lower inwardly diverging wall.

A low radar cross section radome in accordance with this invention features a lower inwardly diverging portion; an intermediate outwardly diverging portion extending upwards from the lower inwardly diverging portion; and a top portion on the intermediate outwardly diverging portion.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
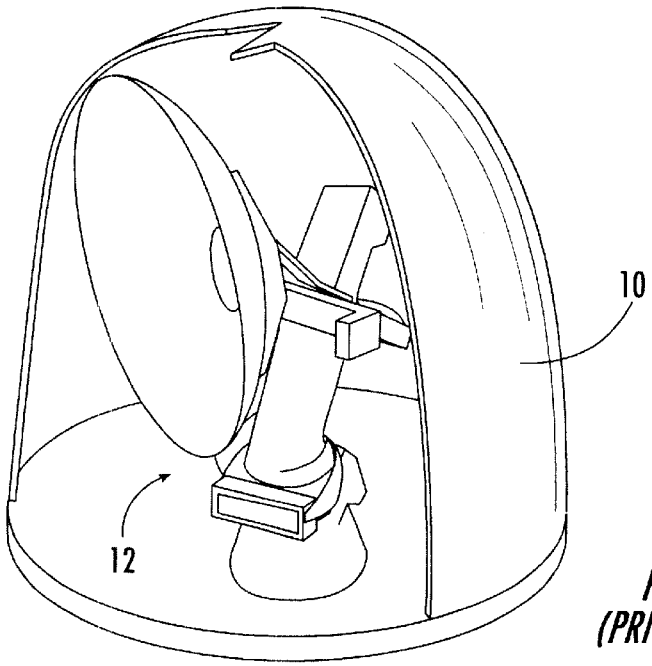
FIG. 1. (PRIOR ART)
FIG. 1 is a schematic three-dimensional partially cutaway view of a typical radome housing an antenna assembly therein.

As discussed in the Background section above, radome 10, FIG. 1 shelters antenna assembly 12 therein against the elements. Typically, there is only about 2 inches of clearance between the outer periphery of antenna assembly 12 and the inner wall of radome 10.

Figure 2:
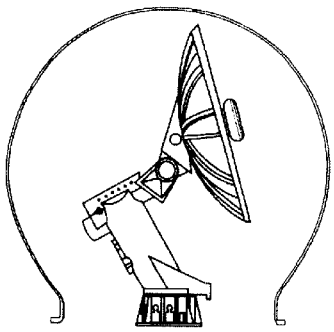
FIG. 2. (PRIOR ART)
FIG. 2 is a schematic view showing a prior art spherical shaped radome.
Figure 3:
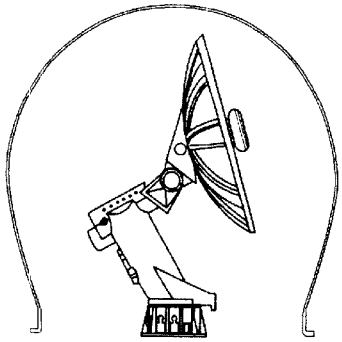
FIG. 3. (PRIOR ART)
FIG. 3 is a schematic view showing a prior art light bulb shaped radome.
Figure 4:
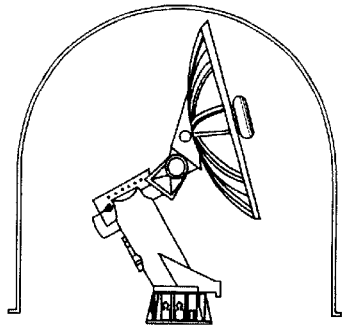
FIG. 4. (PRIOR ART)
FIG. 4 is a schematic view showing a prior art radome having a cylindrical shape.

In the prior art, radome 10, FIG. 1 was typically spherical in shape as shown in FIG. 2, light bulb shaped as shown in FIG. 3, or, less typically, cylindrical in shape as shown in FIG. 4.

These shapes, however, were determined by the inventors hereof to have a relatively high radar cross section (RCS) as discussed infra and, as such, could be detected by enemy radar systems easily.

Figure 5:
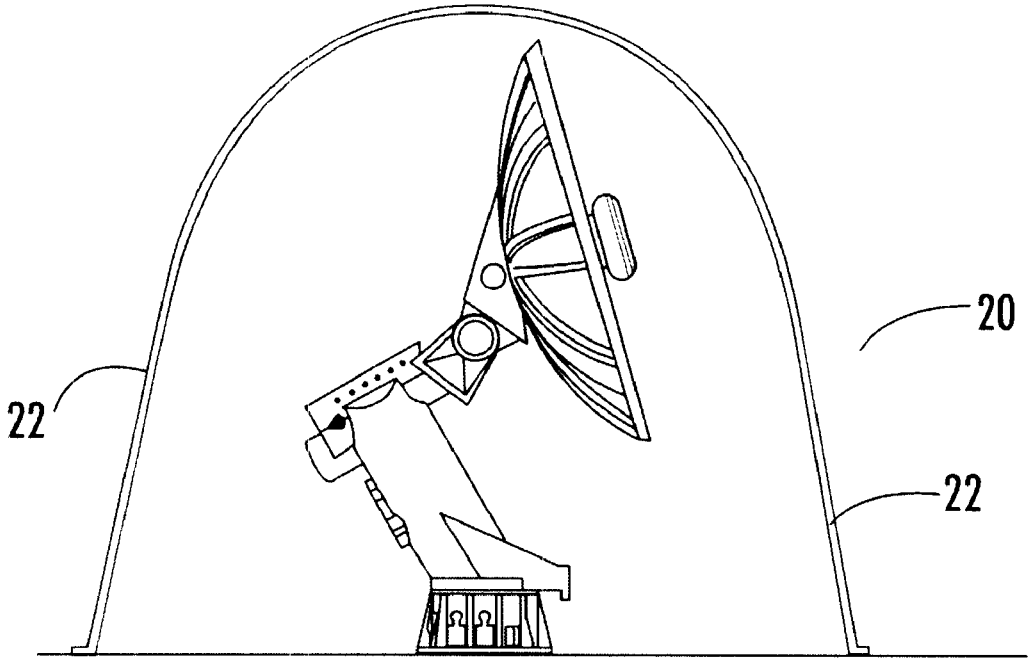
FIG. 5. (PRIOR ART)
FIG. 5 is a schematic view showing a prior art radome having a diverging wall as proposed by the United States Government.

As also discussed in the Background section above, the U.S. Government proposed radome 20, FIG. 5 with outwardly diverging wall 22. Although this design exhibited a lower RCS, its footprint is unduly large and thus it cannot be used in applications where space is premium (e.g., on board a ship) nor can it be easily retrofitted on existing radome installations.

Figure 7:
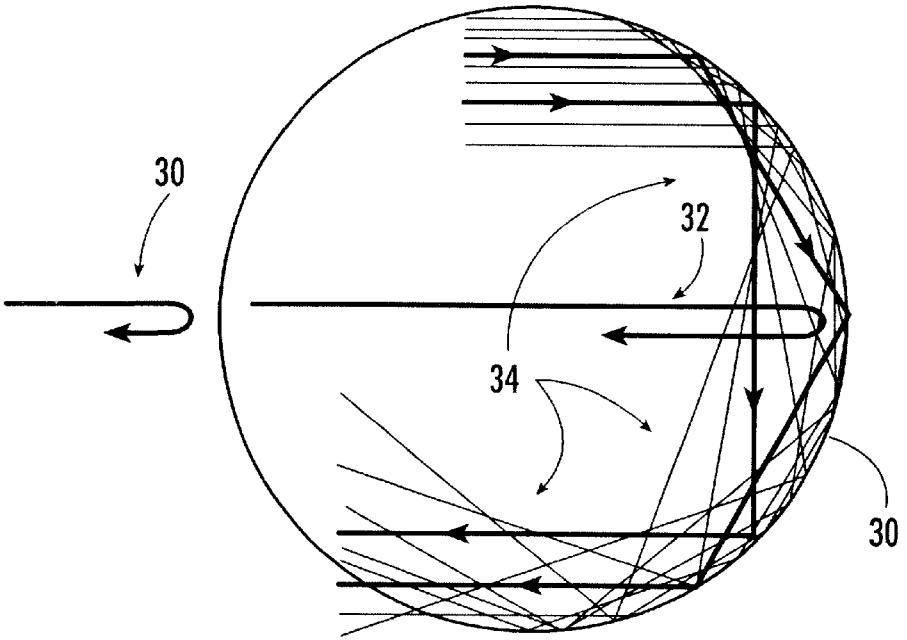
FIG. 7 is a top view of the radome of FIG. 6 showing how the measured radar cross section was high for the prior art light bulb shaped radome design due to internal multiple bounces of the radar energy.
Figure 6:
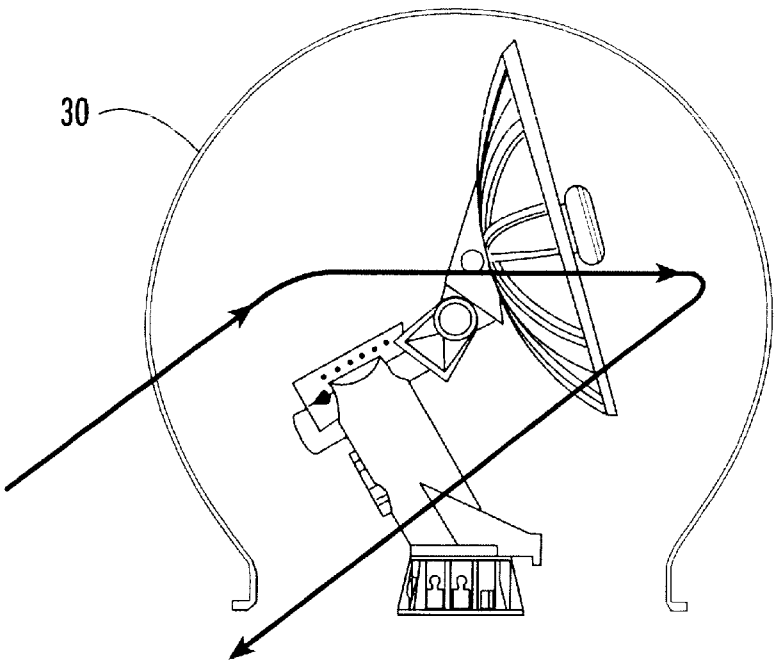
FIG. 6 is a schematic view showing the typical path of radar energy through a prior art light bulb shaped radome.
Figure 8:
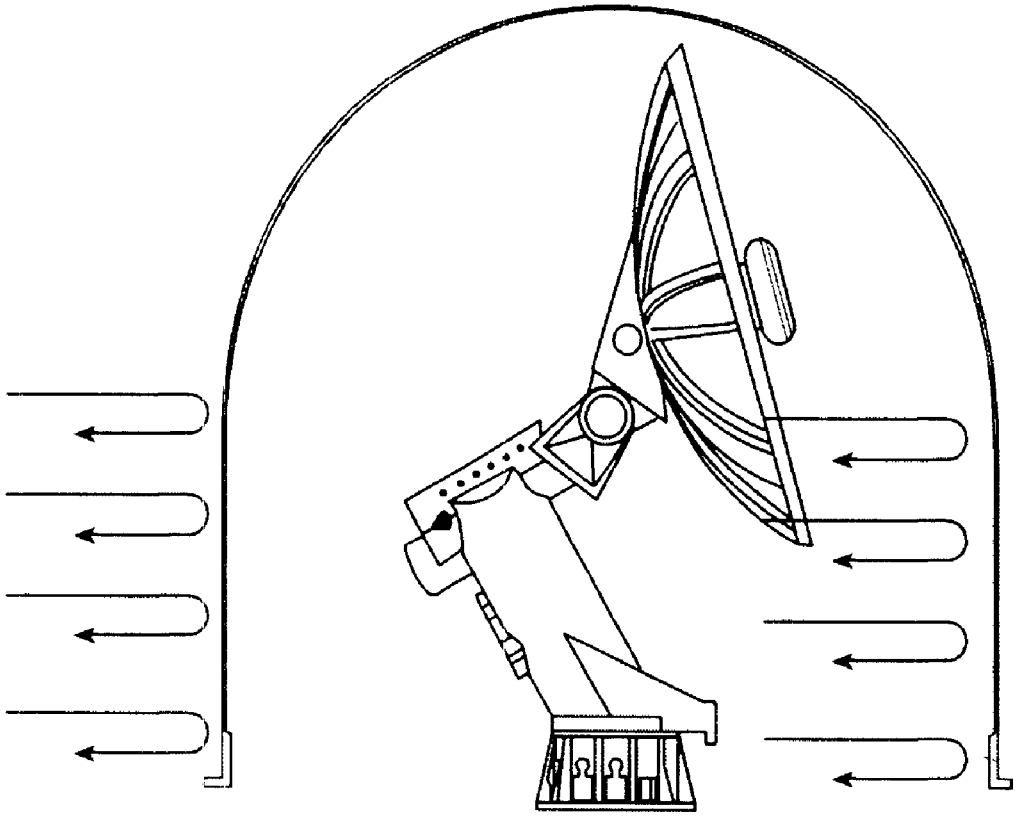
FIG. 8. (PRIOR ART)
FIG. 8 is a schematic view showing the front and back specular reflections from the vertical walls of a prior art cylindrical radome.

As shown in FIGS. 6–7, the measured radar cross section of light bulb shaped radome 30 is high due to external (front wall) specular reflection as shown at 30 in FIG. 7, internal (back wall) specular reflection after passing through the radome as shown at 32, and internal multiple reflections as shown at 34. The cylindrical radome of FIG. 4 has a particularly large front and back specular reflection from its vertical walls as shown in FIG. 8.

The use of Frequency Selective Surfaces (FSS) in conjunction with radomes has also been proposed. The FSS radome passes through only the operational frequency bands but reject other frequencies. FSS, however, is very expensive and has poor performance when the operating frequency is proximate the rejecting frequencies.

Radome 50, FIGS. 9–12, in accordance with this invention, uniquely has a low radar cross section (RCS) and also an acceptable footprint and does not require frequency selective surfaces or suffer from the disadvantages associated therewith.

Radome 50 uniquely features lower inwardly diverging cone portion 52, intermediate outwardly diverging cone portion 54, and curved top portion 56. The divergence angle θ of lower cone portion 52 is typically between 12° and 15°. The divergence angle γ of intermediate cone portion 54 should be at least 10° greater than the divergence angle θ of lower cone portion 52 so that the angle bisector between the lower inwardly diverging and upper outwardly diverging walls of the radome is directed downwards to reduce multiple bounces of radar from the back wall of the radome. In the preferred embodiment, γ is typically between 25° and 35°.

Figure 10:
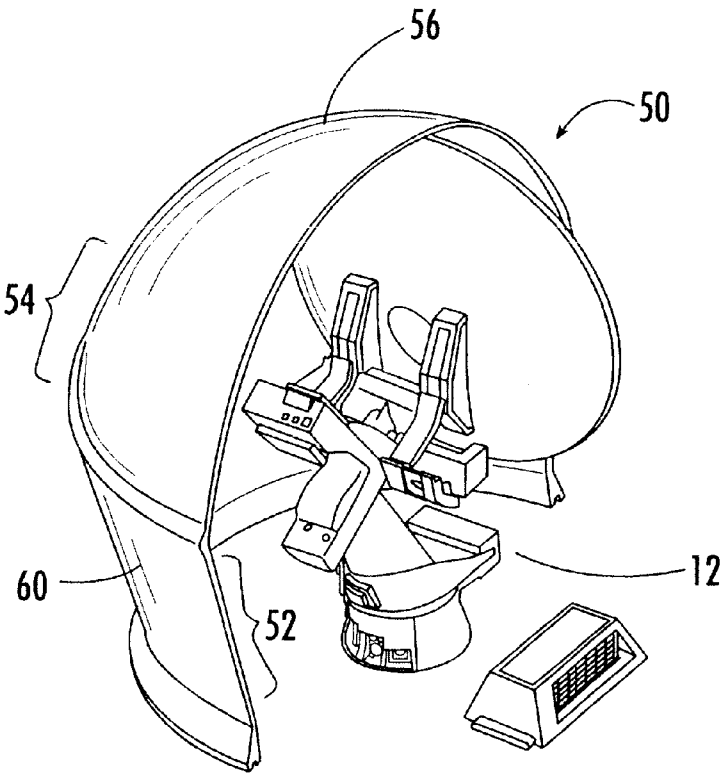
FIG. 10 is a schematic three dimensional partially cutaway view of the low radar cross section radome shown in FIG. 9.
Figure 9:
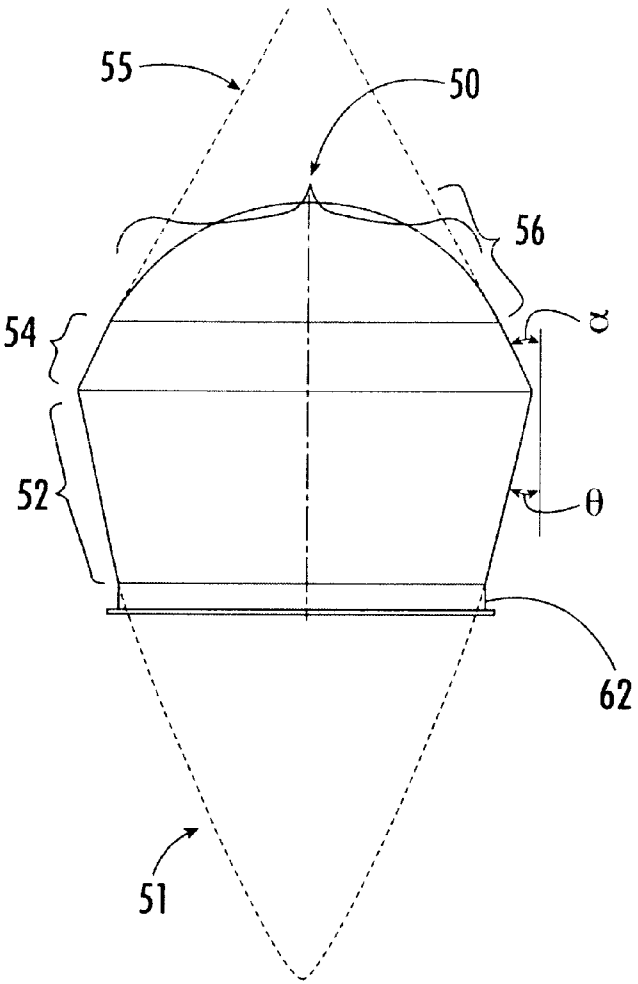
FIG. 9 is a schematic view of one side of the low radar cross section radome of the subject invention.

As shown in FIG. 10, the walls and outer surface 60 of the radome are preferably smooth and continuous about the periphery of the radome for each portion and curved top portion 56 is spherical in shape although these are not necessary limitations of the subject invention. Also, the wall of outwardly diverging cone portion 54 is preferably tangential to the curvature of spherical top portion 56 as shown in FIG. 9. Again, however, this is not a necessary limitation of the subject invention. As shown at 51 in phantom, were the wall of lower inwardly diverging cone portion 52 extended, a cone would be formed. Also, as shown at 55 in phantom, were the wall of outwardly diverging portion 54 extended, it would also form a cone. This preferred construction, however, is not a necessary limitation of the subject invention and alternative designs with different inwardly and outwardly diverging shapes may be used.

In one specific embodiment, base 62 was 71.6 inches in diameter, lower cone portion 52 was 45.6 inches high, θ was 13°, γ was 25°, the radius of curvature of spherical top portion 56 was 43.1 inches, the total height of radome 50 was 84.2 inches and the wall thickness was 0.13 inches. Radome 50 can conveniently be constructed from the materials used to construct prior art conventional radomes.

Figure 11:
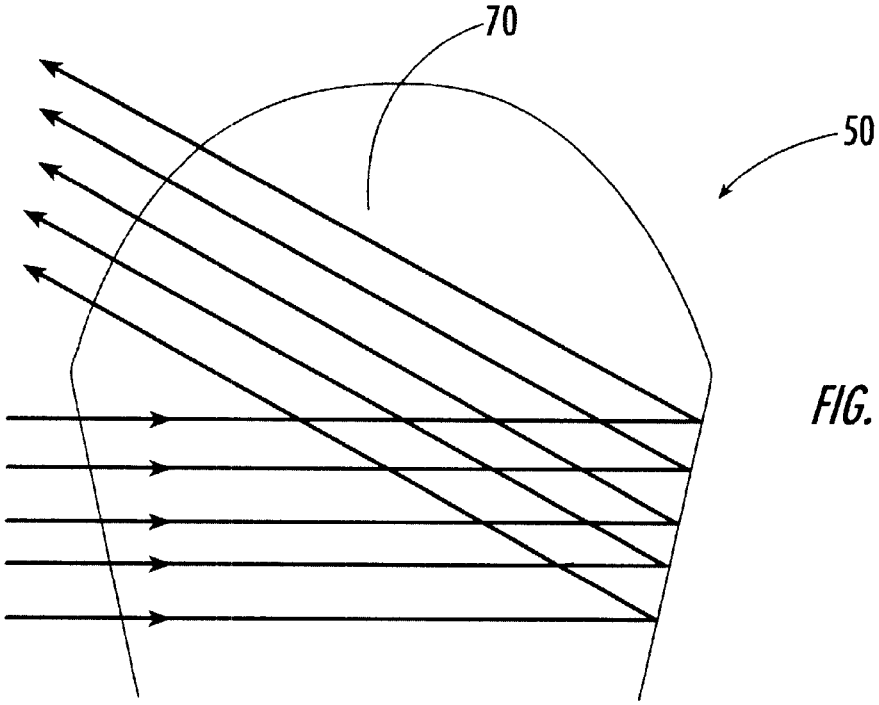
FIG. 11 is a schematic view depicting the diversion of internal radar reflections in the radome of the subject invention.
Figure 12:
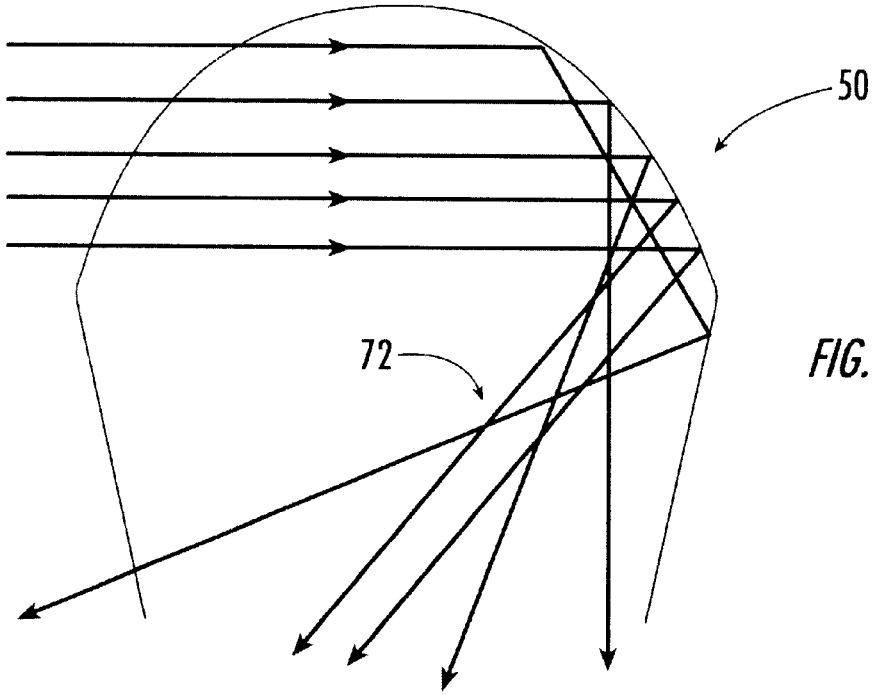
FIG. 12 is a schematic view depicting the reduction of the internal multiple reflections in the radome of the subject invention.

The unique clamshell shape of the radome of this invention deviates somewhat from the prior art spherical shape and only marginally expands the base radius but reduces the radar cross section by changing the front specular spherical surface to the junction of the clamshell, thus diverting the internal specular reflection away from the threat direction as shown at 70 in FIG. 11, and diverting the multiple internal reflections away from the threat direction as shown at 72 in FIG. 12. As such, radome 50, FIGS. 9–12 reduces the radar cross section significantly by geometry modifications without a major cost increase. Specifically, this novel geometry diverts multi-bounce returns, a feature not found in conventional geometries, as shown in FIG. 7. The unique clam shell geometry of this invention also diverts specular returns. The effect on antenna performance is minimal and the footprint remains acceptable.

An analysis undertaken by the inventors hereof shows that angle θ, FIG. 9 (the angle between the lower clam shell wall and a vertical line) should be tilted so that the normal to the wall is a few degrees above the lower angle of the threat elevation window. On the other hand, θ should be kept small enough to prevent double bounce from the internal back wall of the radome. The range of θ is typically from 12°–15°. The range of angle γ (the angle between the upper clam shell wall and the vertical line) is typically between 25°–35°. Angle γ should be as close to 25° as possible to minimize the transmitting degradation due to insertion phase variation caused by the junction between the upper and lower walls of the clam shell shape. Angle γ should be at least 10° larger than angle θ so that the angle bisector between the lower and upper walls of the clam shell shape is directed downwards, and multiple bounces from the back wall of the radome minimized. It, however, possible to adapt these angles for any threat direction. In the preferred design shown in FIG. 9, the threat direction is typically along the horizon.

Figure 14:
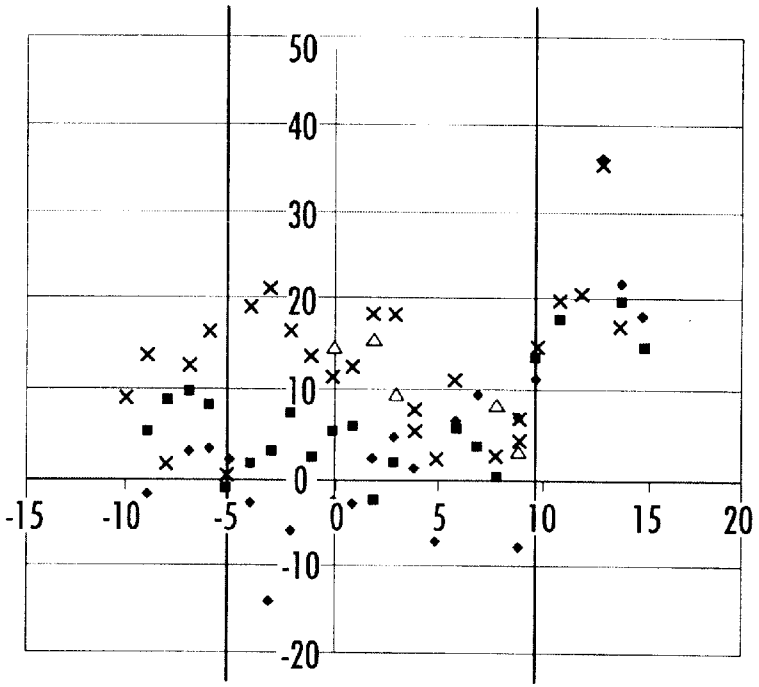
FIG. 14 is a graph showing the calculated radar cross section at 9 GHz for the low radar cross section radome of the subject invention.
Figure 13:
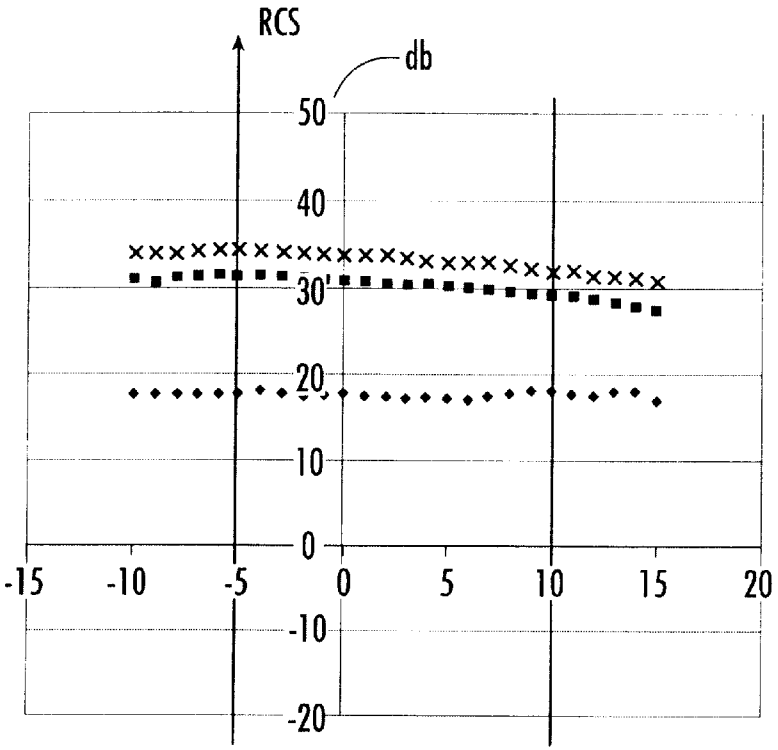
FIG. 13 is a graph showing the calculated radar cross section at 9 GHz for a prior art light bulb shaped radome.

The radome of the subject invention was constructed for testing and proven to have a very low radar cross section when compared with prior art radomes. FIGS. 13 and 14 compare the radar cross section at 9 GHz for a prior art light bulb shaped radome (FIG. 13) with the low radar cross section radome of the subject invention shown in FIGS. 9–12. In each figure, the horizontal axis is the elevation angle and the vertical axis is in decibels. The primary area of interest is an elevation angle of between −5° and 10°. As shown in FIG. 13, the prior art light bulb shaped radome exhibited radar cross section values well above 20 dB primarily due to internal multiple bounces as discussed with respect to FIGS. 6 and 7 above. The clam shell shaped radome of FIGS. 9–12 exhibited lower radome cross section values as shown in FIG. 14 because multiple internal reflections are minimized as shown in FIG. 12.

As such, radome 50, FIG. 9 has a low radar cross section proven through testing to meet the United States Government's requirements. Radome 50 does not block radar signals returning from a target from reaching the antenna assembly housed within the radome and, moreover, radome 50 has a small footprint rendering it suitable to be retrofitted for use in conjunction with existing antenna assembly installations. By designing radome 50 to have curved top portion 56, outwardly diverging wall 54 extending from curved top portion 56, and inwardly diverging wall 52 extending from outwardly diverging wall 54 down to the base portion 62 of the radome, the radar cross section of radome 50 is lower than the radar cross section associated with the radome shapes shown in FIGS. 2–4 and yet, at the same time, radome 50 has a smaller footprint than the radome shown in FIG. 5.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A low radar cross section radome comprising:

a lower inwardly diverging cone portion having a top periphery;

an intermediate outwardly diverging cone portion having a bottom periphery on the lower inwardly diverging cone portion, the top periphery of the lower inwardly diverging cone portion contiguous to the bottom periphery of the intermediate outwardly diverging cone portion; and a curved top on the intermediate outwardly diverging cone portion.

2. The low radar cross section radome of claim 1 in which the divergence angle of the lower cone portion is between 12° and 15°.

3. The low radar cross section radome of claim 1 in which the divergence angle of the intermediate cone portion is between 25° and 35°.

4. The low radar cross section radome of claim 1 in which the divergence angle of the intermediate cone portion is 10° greater than the divergence angle of the lower cone portion.

5. The low radar cross section radome of claim 1 in which the outer surface of the radome is smooth and continuous.

6. The low radar cross section radome of claim 1 in which the curved top portion is spherical in shape.

7. A low radar cross section radome comprising:

a lower inwardly diverging wall;

an intermediate outwardly diverging wall extending upwards from the lower inwardly diverging wall; and a curved top portion on the intermediate outwardly diverging wall, the divergence angle of the lower inwardly diverging wall being between 12° and 15° and the divergence angle of the intermediate outwardly diverging wall being 10° greater than the divergence angle of the lower inwardly diverging wall.

8. A low radar cross section radome comprising:

a lower inwardly diverging portion having a top periphery;

an intermediate outwardly diverging portion having a bottom periphery extending upwards from the lower inwardly diverging portion, the top periphery of the lower inwardly diverging portion contiguous to the bottom periphery of the intermediate outwardly diverging portion; and a top portion on the intermediate outwardly diverging portion.

* * * * *